US011678732B2

(12) United States Patent
Lee et al.

(10) Patent No.: US 11,678,732 B2
(45) Date of Patent: Jun. 20, 2023

(54) COSMETIC CONTAINER ASSEMBLY CAPABLE OF SIMULTANEOUSLY DISCHARGING MULTIPLE KINDS OF CONTENTS

(71) Applicant: APOLLO INDUSTRIAL CO., LTD., Siheung-si (KR)

(72) Inventors: Yong Dae Lee, Seoul (KR); Jae Kyung Lee, Incheon (KR)

(73) Assignee: APOLLO INDUSTRIAL CO., LTD., Siheung-si (KR)

( * ) Notice: Subject to any disclaimer, the term of this patent is extended or adjusted under 35 U.S.C. 154(b) by 168 days.

(21) Appl. No.: 17/462,821

(22) Filed: Aug. 31, 2021

(65) Prior Publication Data

US 2022/0104601 A1 Apr. 7, 2022

Related U.S. Application Data

(63) Continuation of application No. PCT/KR2020/013447, filed on Oct. 5, 2020.

(51) Int. Cl.

| | |
|---|---|
| ***A45D 40/24*** | (2006.01) |
| ***B05B 11/00*** | (2023.01) |
| ***B05B 12/00*** | (2018.01) |
| ***B05B 11/10*** | (2023.01) |

(52) U.S. Cl.

CPC ..... *A45D 40/24* (2013.01); *B05B 11/0078* (2013.01); *B05B 11/1009* (2023.01); (Continued)

(58) Field of Classification Search

CPC ..... B05B 11/1081; B05B 11/0054; B05B 11/0038; B05B 11/1084; B05B 11/1056; (Continued)

(56) References Cited

U.S. PATENT DOCUMENTS 4,179,070 A * 12/1979 Tada ..... B05B 11/1011 222/321.7
2001/0025860 A1* 10/2001 Auer ..... B05B 11/1084 222/137

(Continued)

FOREIGN PATENT DOCUMENTS

KR 20-2015-0000917 U 3/2015
KR 10-2148690 B1 8/2020

(Continued)

*Primary Examiner* — Patrick M. Buechner
(74) *Attorney, Agent, or Firm* — NKL Law; Jae Youn Kim

(57) ABSTRACT

A cosmetic container assembly capable of simultaneously discharging multiple kinds of contents through a single pumping action is disclosed. The cosmetic container assembly includes a plurality of cosmetic containers, each of which includes a container and a pump dispenser, a press plate, which includes connection ports connected to hollow piston rods, a discharge port, a discharge channel connecting the connection ports with the discharge port, and a support shaft, a container housing including a base, a housing cap including a shaft hole and a button-supporting shaft, and a lever push button, which is coupled to the button-supporting shaft and includes a press portion configured so as to press the support shaft to move the press plate downwards to thus simultaneously press the pump dispensers when the lever push button is pressed.

2 Claims, 6 Drawing Sheets

(52) U.S. Cl.
CPC ..... *B05B 11/1084* (2023.01); *B05B 12/002* (2013.01); *A45D 2200/055* (2013.01); *A45D 2200/056* (2013.01)

(58) Field of Classification Search
CPC ..... B05B 11/1057; B05B 11/1009; B05B 12/002; B05B 11/0078; A45D 2200/056; A45D 2200/055; A45D 40/24
See application file for complete search history.

(56) References Cited

U.S. PATENT DOCUMENTS

| | | | | |
|---|---|---|---|---|
| 2002/0117516 | A1* | 8/2002 | Lasserre | B05B 11/1084 222/145.5 |
| 2003/0089738 | A1 | 5/2003 | Peterson | |
| 2010/0044394 | A1* | 2/2010 | Milian | B05B 11/1084 222/137 |
| 2011/0315712 | A1* | 12/2011 | Chiba | B05B 11/1009 222/137 |
| 2012/0241474 | A1* | 9/2012 | Dennis | B05B 15/30 222/137 |
| 2012/0241475 | A1* | 9/2012 | Dennis | B05B 11/1084 222/137 |
| 2016/0286932 | A1* | 10/2016 | Lee | B05B 11/026 |
| 2022/0055054 | A1* | 2/2022 | Lee | B65D 81/325 |

FOREIGN PATENT DOCUMENTS

| | | | |
|---|---|---|---|
| KR | 10-2157834 | B1 | 9/2020 |
| KR | 10-2164743 | B1 | 10/2020 |

* cited by examiner

COSMETIC CONTAINER ASSEMBLY CAPABLE OF SIMULTANEOUSLY DISCHARGING MULTIPLE KINDS OF CONTENTS

CROSS REFERENCES TO RELATED APPLICATION

This application is a continuation of PCT/KR2020/013447, filed Oct. 5, 2020, the entire disclosure of which is incorporated herein by reference.

TECHNICAL FIELD

The present invention relates to a cosmetic container assembly, and more particularly to a cosmetic container assembly capable of simultaneously discharging multiple kinds of contents contained in a plurality of containers while mixing the contents with each other through a single pumping action.

BACKGROUND ART

In general, a liquid or paste cosmetic preparation (hereinafter, referred to as liquid contents) is contained in a cosmetic container equipped with a pump dispenser. A predetermined amount of the liquid contents contained in the cosmetic container is discharged and used whenever the push head of the pump dispenser is pressed.

These days, dual-type cosmetic preparations, which are capable of realizing two effects using a single product, are commercially available. For example, there are cosmetic products in which a base material in a paste form and a powder or liquid ingredient capable of producing a specific effect such as whitening are mixed together and then used. Because there is the concern of rapid deterioration of the base material and the powder or liquid ingredient of such dual-type cosmetic preparations when the base material and the powder or liquid ingredient are mixed with each other in advance, the dual-type cosmetic preparations are configured such that the base material and the powder or liquid ingredient are directly mixed with each other by a user prior to use. Accordingly, there is demand for a dual-type cosmetic container capable of discharging multiple kinds of cosmetic contents while mixing them with each other. Such a dual-type cosmetic container is disclosed in Korea Patent Registration No. 10-1446612.

The cosmetic container disclosed in Korea Patent Registration No. 10-1446612, which aims to provide a cosmetic container capable of separately containing two kinds of contents and of discharging them, characteristically includes a container unit, which is constituted by a first container containing a first composition and a second container containing a second composition in which the first and second containers are coupled to each other so as to define a cylindrical form, a first airless pump module mounted on the first container, a second airless pump module mounted on the second container, and a push unit, which is constituted by a first push cap, which is mounted on the first airless pump module and has therein a first discharge hole, and a second push cap, which is mounted on the second airless pump module and has therein a second discharge hole. Consequently, a user is able to discharge and use only the composition contained in the first container or the second container by pressing the first push cap or the second push cap or to simultaneously discharge and use both the compositions contained in the first and second containers by simultaneously pressing both the first and second push caps.

However, the dual-type cosmetic container has a disadvantage in that one of the compositions in the two containers is first exhausted whereas some of the other of the compositions remains in the container when the two compositions are dispensed separately by pressing respective push caps. Meanwhile, the dual-type cosmetic container is used in such a way as to simultaneously discharge the compositions contained in the first and second containers by simultaneously pressing the first and second push caps. In this case, there is inconvenience in use in that the first and second push caps must be pressed with considerable force using the thumb.

DISCLOSURE

Technical Problem

Therefore, the present invention has been made in view of the above problems, and it is an object of the present invention to provide a cosmetic container assembly which is capable of simultaneously discharging multiple kinds of contents contained in a plurality of containers through a single pumping action and which enables pump dispensers mounted on the plurality of containers to be simultaneously pumped or operated even when the pump dispensers are lightly pressed.

Technical Solution

In accordance with the present invention, the above and other objects can be accomplished by the provision of a cosmetic container assembly capable of simultaneously discharging multiple kinds of contents through a single pumping action including a plurality of cosmetic containers, each of which includes a container, which contains contents therein and is open at an upper end thereof, and a pump dispenser, which is mounted in the open end of the container and is capable of pumping the contents in the container to extrude the contents upwards through a hollow piston rod by repeated pressing action of the hollow piston rod, a press plate, which is horizontally disposed above the cosmetic containers, the press plate including connection ports formed in a lower surface thereof at regular intervals so as to allow upper ends of the piston rods of the pump dispensers to be respectively fitted thereinto, a discharge port formed in a periphery thereof so as to discharge the contents, a discharge channel formed therein so as to connect the connection ports with the discharge port, and a support shaft formed in the central region of an upper surface thereof so as to project upwards, a container housing, which is configured to have a cylindrical form so as to surround the cosmetic containers and the press plate and which is open at an upper portion thereof and is provided at a lower portion thereof with a base on which the plurality of cosmetic containers are disposed at regular intervals, a housing cap, which is coupled to the upper portion of the container housing, which accommodates therein the cosmetic containers and the press plate, so as to cover the upper portion and which is provided in a center thereof with a shaft hole, through which the support shaft of the press plate extends upwards, and is provided with a button-supporting shaft in front of the shaft hole, and a lever push button, which is rotatably coupled at a front end thereof to an upper end of the button-supporting shaft via a shaft and is provided with a press portion configured to press the support shaft of the press plate and which is configured to move the press plate downwards and thus to simultaneously press the pump dispensers of the cosmetic containers to perform a pumping action when a rear end of the lever push button is pressed.

The discharge port may be formed at a peripheral portion of the press plate so as to extend upwards, and may be provided at the upper end thereof with a nozzle tip configured to discharge the contents forwards.

Advantageous Effects

The cosmetic container assembly capable of simultaneously discharging multiple kinds of contents according to the present invention, which is constructed as described above, has an advantage in that, when the rear end of the lever push button is pressed, the press plate is moved downwards and thus the pump dispensers of the cosmetic containers are pressed simultaneously so as to simultaneously discharge the contents while mixing the same with each other. Particularly, since the pump dispensers of the cosmetic containers are simultaneously pumped by lightly pressing the rear end of the push button, which adopts the principle of a lever, it is possible to improve convenience in use. Furthermore, since the various kinds of contents in the cosmetic containers are discharged in equal amounts through a single pumping action, there is a functional effect of preventing contents from remaining in any of the cosmetic containers.

In addition, since the cosmetic container assembly capable of simultaneously discharging multiple kinds of contents according to the present invention is constructed such that mixed contents are discharged through a nozzle tip connected to the discharge port, it is possible to allow a user to more easily use the cosmetic container assembly.

DESCRIPTION OF DRAWINGS

The above and other objects, features and other advantages of the present invention will be more clearly understood from the following detailed description taken in conjunction with the accompanying drawings, in which.

DESCRIPTION OF REFERENCE NUMERALS

| | |
|---|---|
| 100 cosmetic container | 110 container |
| 120 pump dispenser | 121 cap |
| 122 cylinder | 123 pressure chamber |
| 124 suction tube | 125 piston rod |

-continued

| | |
|---|---|
| 126 coil spring | 127 inlet port |
| 128 check valve | 200 press plate |
| 210 connection port | 220 discharge channel |
| 230 discharge port | 240 nozzle tip |
| 250 support shaft | 300 container housing |
| 310 base | 311 seating slot |
| 400 housing cap | 410 shaft hole |
| 420 button-supporting shaft | |
| 500 lever push button | 510 shaft |
| 520 press portion | 600 cap cover |

Best Mode

Hereinafter, a preferred embodiment of the present invention will be described in detail with reference to the accompanying drawings. Briefly explaining the accompanying drawings, FIGS. 1 to 7 illustrate the construction of a cosmetic container assembly according to the present invention. FIG. 8 illustrates the operation of the cosmetic container assembly according to the present invention.

<Description of the Construction of the Cosmetic Container Assembly According to the Present Invention>

First, the construction of the cosmetic container assembly according to the present invention will be described.

Figure 1:
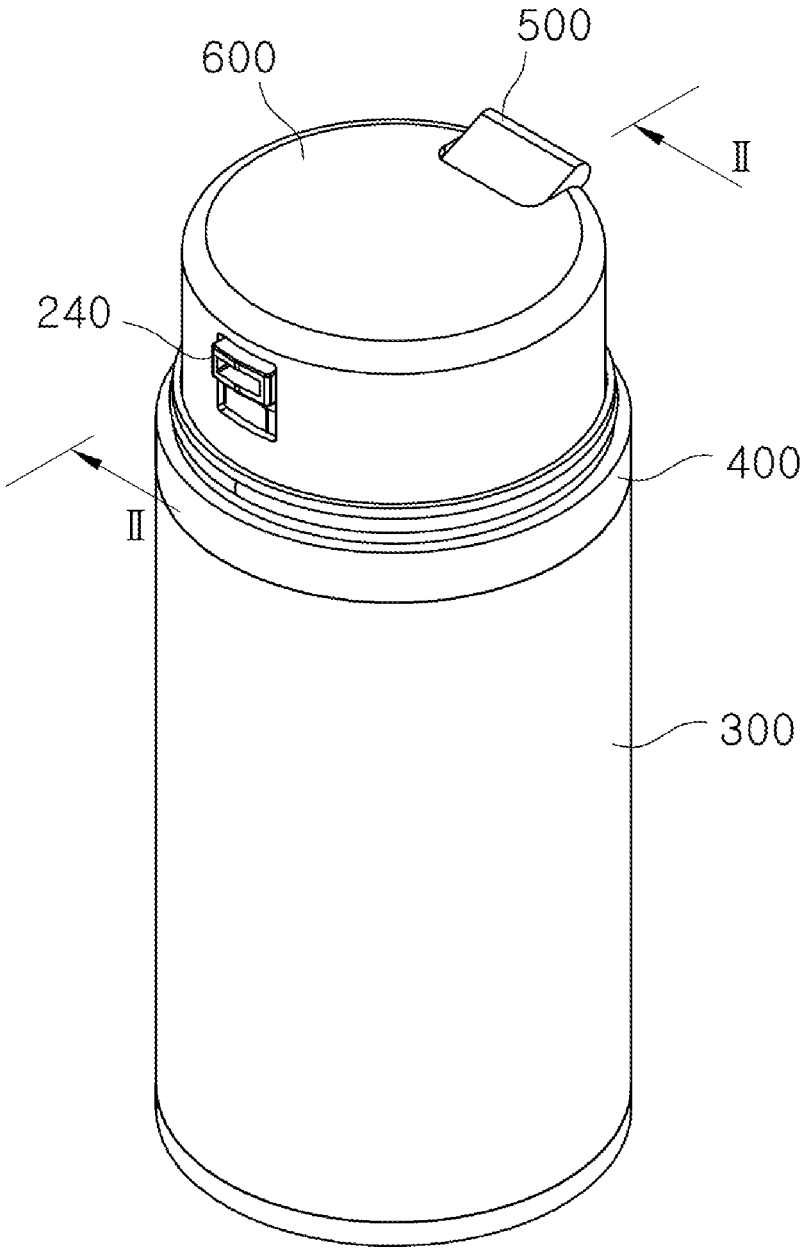
FIG. 1 is a perspective view illustrating a cosmetic container assembly according to the present invention.
Figure 2:
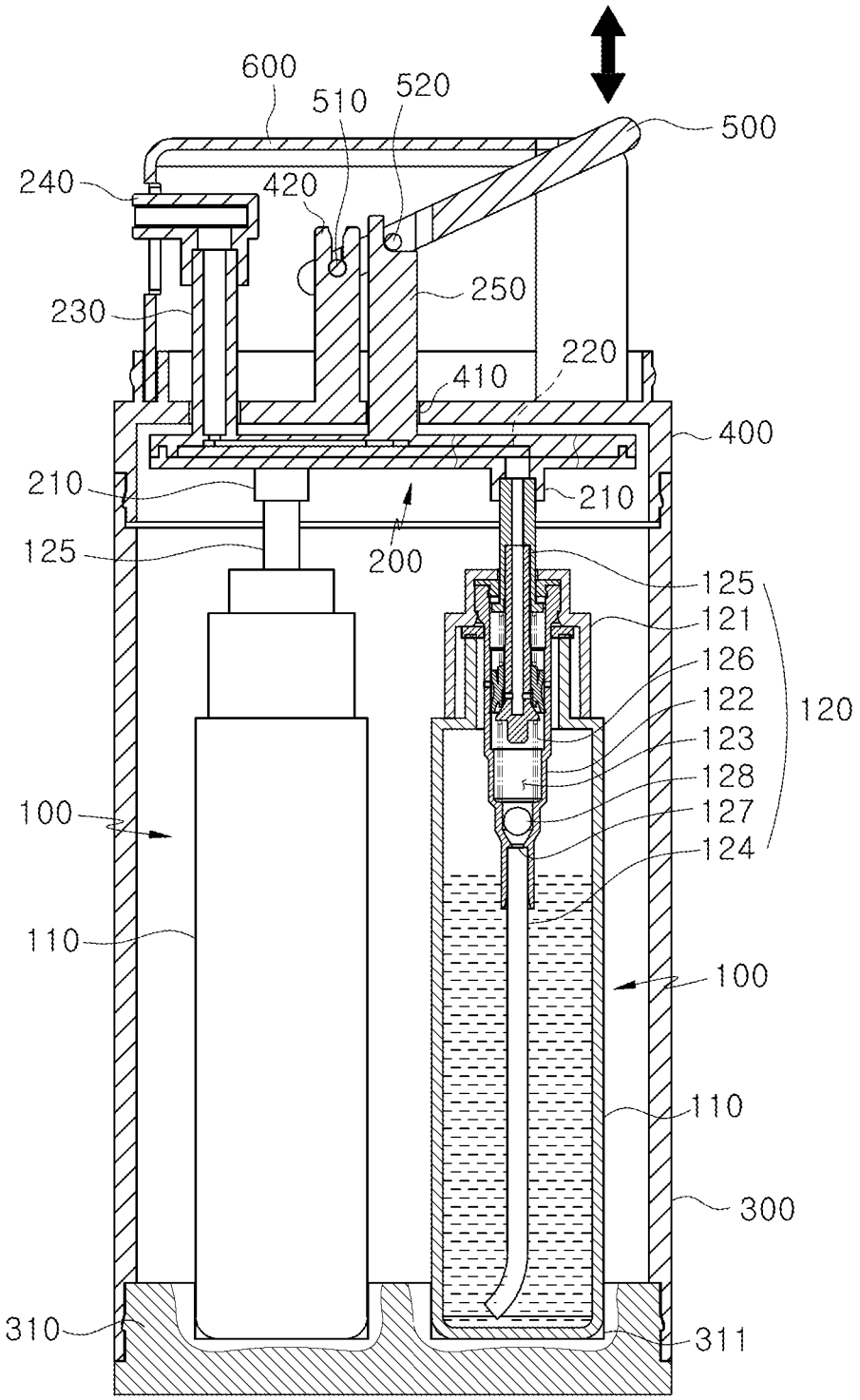
FIG. 2 is a cross-sectional view taken along line II-II in FIG. 1, which illustrates the internal structure of the cosmetic container assembly according to the present invention.

The cosmetic container assembly according to the present invention is intended to simultaneously discharge multiple kinds of contents through a single pumping action. As illustrated in FIGS. 1 and 2, the cosmetic container assembly according to the present invention includes a plurality of cosmetic containers 100, each of which includes a container 110 containing therein contents and a pump dispenser 120 mounted to the container 110, a press plate 200, which is horizontally disposed above the cosmetic containers 100 and is configured to simultaneously press the pump dispensers 120 of the cosmetic containers 100 to thus discharge the contents in the containers to the outside, a container housing 300 configured to accommodate therein the cosmetic containers 100 and the press plate 200, a housing cap 400 coupled to the upper portion of the container housing 300 so as to cover the upper portion, and a lever push button 500, which is disposed above the housing cap 400 so as to lightly press and actuate the press plate 200 using the principle of a lever (in FIG. 2, one of the cosmetic containers 100 is illustrated in a cross-sectional view for easy understanding).

Figure 3:
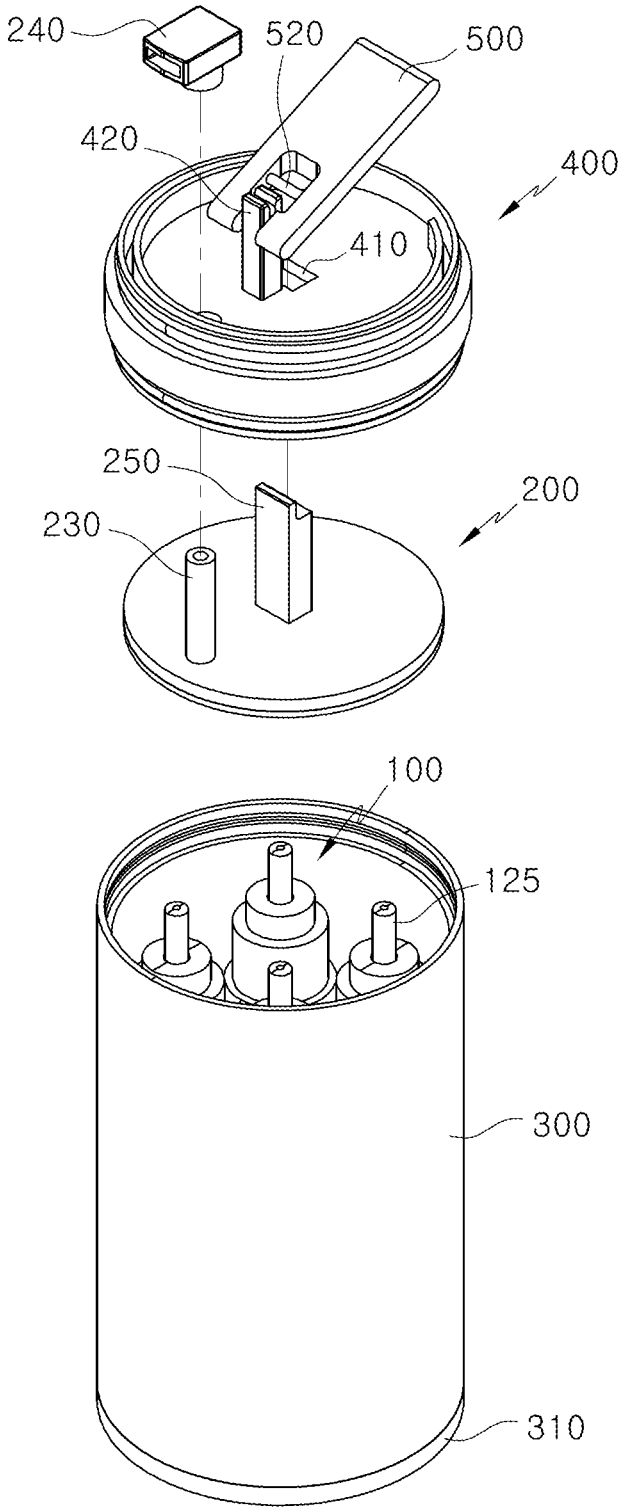
FIG. 3 is an exploded perspective view illustrating the internal structure of the cosmetic container assembly according to the present invention.

Referring to FIGS. 2 and 3, each of the plurality of cosmetic containers 100 includes the container 110, which contains therein contents and is open at the upper end thereof, and the pump dispenser 120, which is mounted in the open end of the container 110 so as to pump the contents of the container 110 to thus extrude the contents upwards through a hollow piston rod 125 through a repeated pressing action of the piston rod 125. The pump dispenser 120 includes a cap 121 mounted on the open end of the container 110, a cylinder 122, which is disposed inside the cap 121 at the center thereof and defines therein a pressure chamber 123, into which the contents are sucked through a suction tube 124 and temporarily stored, a hollow piston rod 125, the lower end of which is received in the cylinder 122 so as to be moved vertically and the upper end of which extends upwards through the central region of the cap 121, a coil spring 126, which is disposed in the cylinder 122 so as to elastically support the piston rod 125 upwards, and a ball-shaped check valve 128 configured to open and close an inlet port of the lower end of the cylinder 122 depending on variation in the pressure in the pressure chamber 123. In the pump dispenser 120, when the piston rod 125 is lowered by external force, the pressure in the pressure chamber 123 is increased, extruding the contents temporarily stored therein upwards through the hollow in the piston rod 125. When the external force applied to the piston rod 125 is removed, the piston rod 125 is raised by the elastic restoring fore of the coil spring 126, and the check valve 128 is also raised and is opened so as to allow the contents in the container 110 to be sucked into the suction tube 124.

Figure 4:
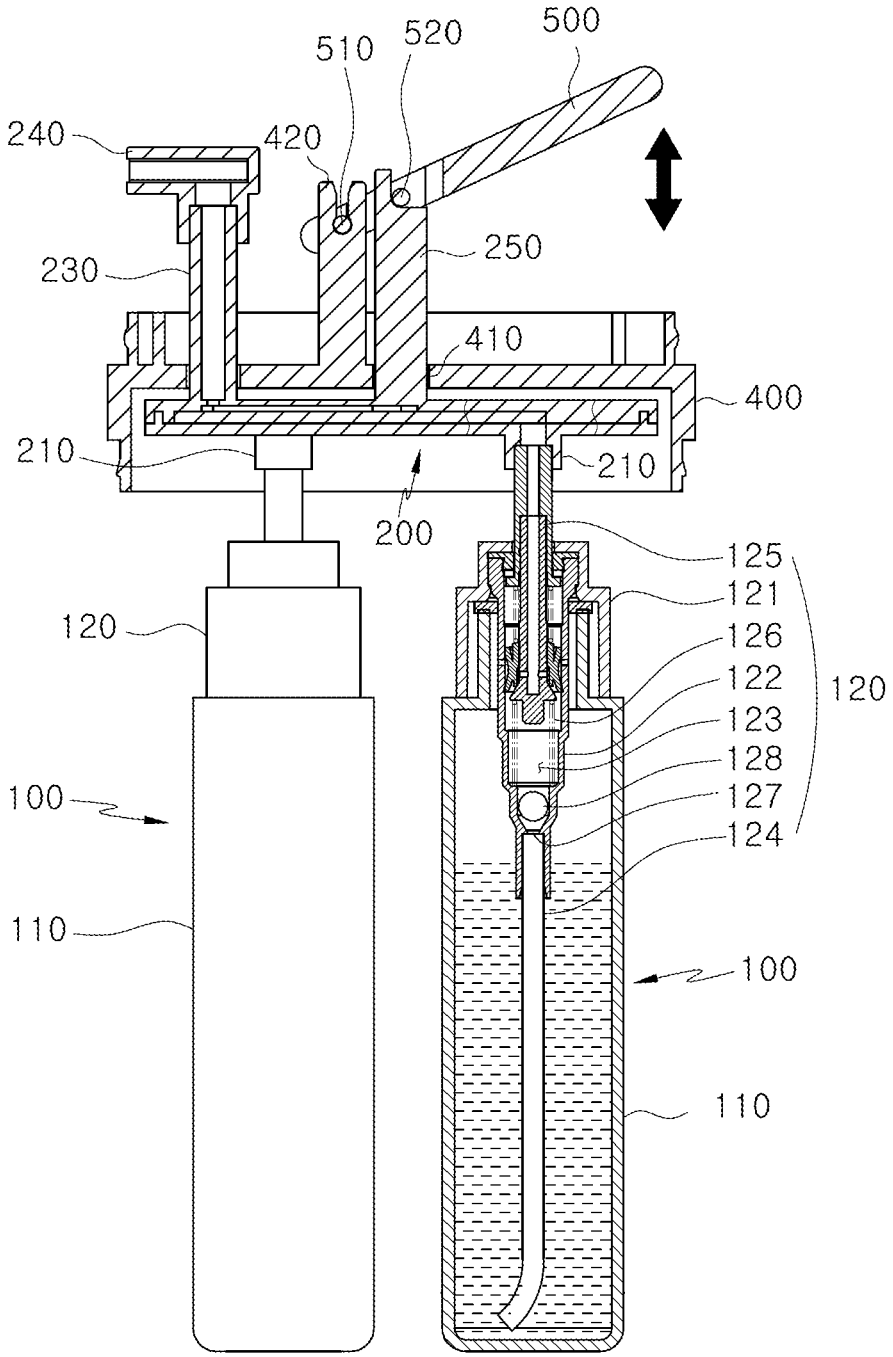
FIG. 4 is a view illustrating the coupling structure between cosmetic containers, a press plate, and a lever push button of the cosmetic container assembly according to the present invention.
Figure 5:
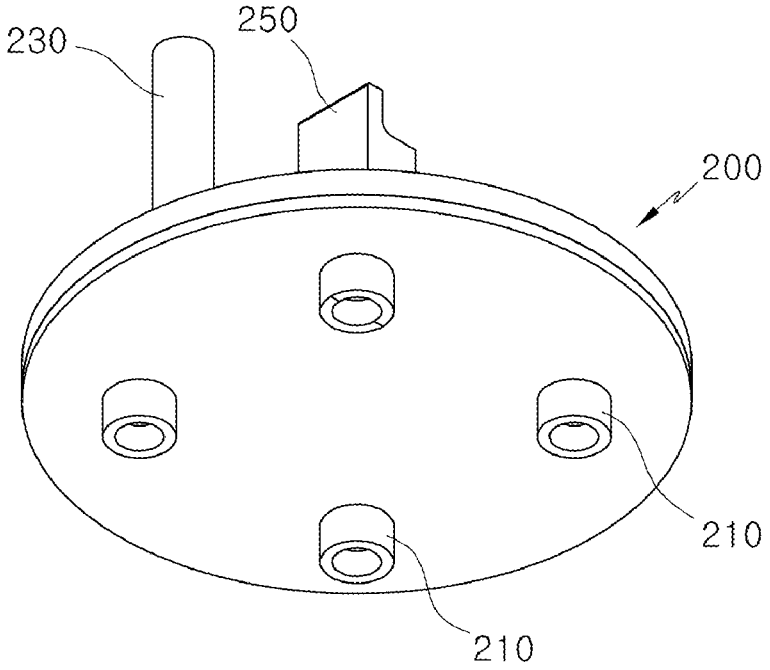
FIG. 5 is a perspective view illustrating the bottom structure of the press plate according to the present invention.
Figure 6:
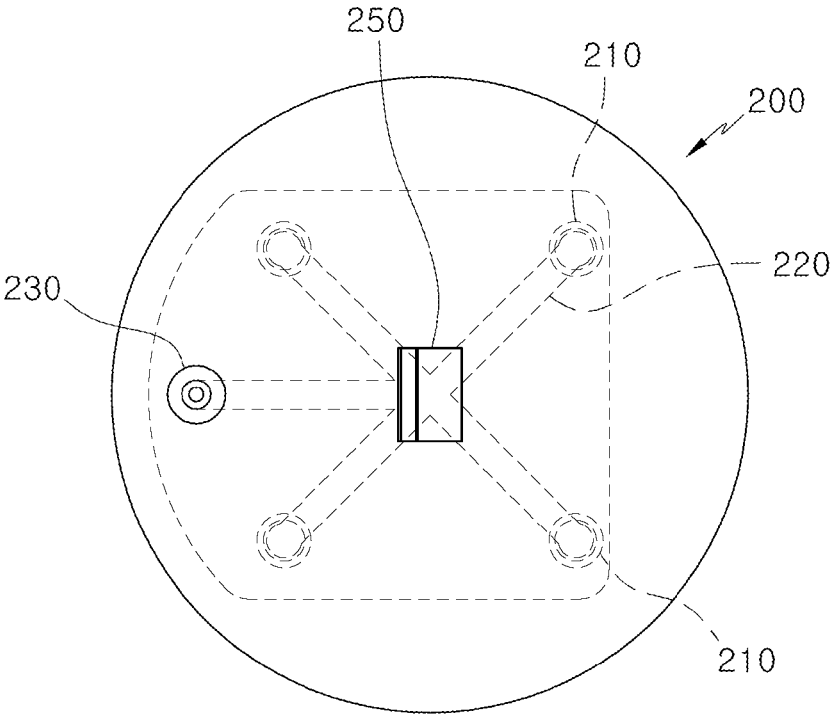
FIG. 6 is a schematic view illustrating the internal structure of the press plate according to the present invention.

As illustrated in FIGS. 3 to 5, the press plate 200 is horizontally disposed above the cosmetic containers 100. The press plate 200 is composed of a disc-shaped plate having a predetermined thickness, and is provided in the lower surface thereof with connection ports 210 at regular intervals (intervals of 90 degrees), into which the upper ends of the piston rods 125 of the pump dispensers 120 are fitted. Furthermore, the press plate 300 is provided at the periphery thereof with an outlet port 230 so as to discharge the contents therein while mixing the contents with each other. As illustrated in FIG. 6, the press plate 200 is provided therein with a discharge channel 220, which connect the connection ports 210 with the discharge port 230. A support shaft 250 projects upwards from the center of the upper surface of the press plate 200. The reason for this is to move the press plate 200 downwards to thus simultaneously press the piston rods 125 of the pump dispensers 120 when the lever push button 500 is pushed. According to the embodiment of the present invention, the discharge port 230 extends upwards through the housing cap 400, and is coupled to a nozzle tip 240 configured to discharge the contents forwards (see FIG. 4). Accordingly, a user can easily dispense and use the contents discharged through the nozzle tip 240.

The container housing 300 is configured to have a cylindrical form, which surrounds the plurality of cosmetic containers 100 and the press plate 200 and is open at the upper end thereof. As illustrated in FIGS. 2 and 3, the plurality of cosmetic containers 100 are disposed on a base 310 of the container housing 300 at regular intervals in the state of being erected. To this end, the base 310 is provided therein with a plurality of seating recesses 311 at regular intervals such that the lower portions of the containers 110 of the cosmetic containers 100 are seated in the seating recesses 311. According to the embodiment of the present invention, four cosmetic containers 100 are disposed on the base 310 at an angular interval of 90 degrees.

The housing cap 400 is coupled to the upper portion of the container housing 300, which accommodates therein the cosmetic containers 100 and the press plate 200, so as to cover the upper portion. As illustrated in FIGS. 2 to 4, the housing cap 400 is provided in the center thereof with a shaft hole 410 so as to allow the support shaft 250 to extend upwards therethrough. Furthermore, the housing cap 400 is provided with a button-supporting shaft 420 in front of the shaft hole 410 so as to support the lever push button 500. The housing cap 400 may be held in place in the open end of the container housing 300 in an interference fit manner.

As illustrated in FIGS. 2 to 4, the lever push button 500 is coupled at the front end thereof to the upper end of the button-supporting shaft 420 via a shaft 510. The front end of the lever push button 500 is provided with a press portion 520, which is configured to press the support shaft 250 of the press plate 200 in the state of being in contact therewith. Because the lever push button 500 employs the principle of a lever, the press portion 520 is capable of pressing the press plate 200 with a considerable force even when the rear end of the lever push button 400 is only lightly pressed (see the arrow direction in FIG. 3). Consequently, even when the rear end of the lever push button 500 is lightly pressed, the press plate 200 is pressed downwards, and the pump dispensers 120 of the cosmetic containers 100 are simultaneously pressed, thereby performing the pumping action.

Furthermore, the housing cap 400 is provided at the upper portion thereof with a cap cover 600, which covers the upper portion of the housing cap 400 while allowing an action of pressing the lever push button 500 (see FIGS. 1 and 2).

<Description of Operation and Effect of the Cosmetic Container Assembly According to the Present Invention>

Hereinafter, the operation and effects of the cosmetic container assembly according to the present invention, which is constructed as described above, will be described with reference to FIGS. 2 and 7.

As illustrated in FIG. 2, in the initial state of the cosmetic container assembly according to the present invention, the piston rods 125 are in the state of being raised by the elastic restoring force of the coil springs 126 of the pump dispensers 120 of the cosmetic containers 100, and the press plate 300 is also in the state of being raised.

Figure 7:
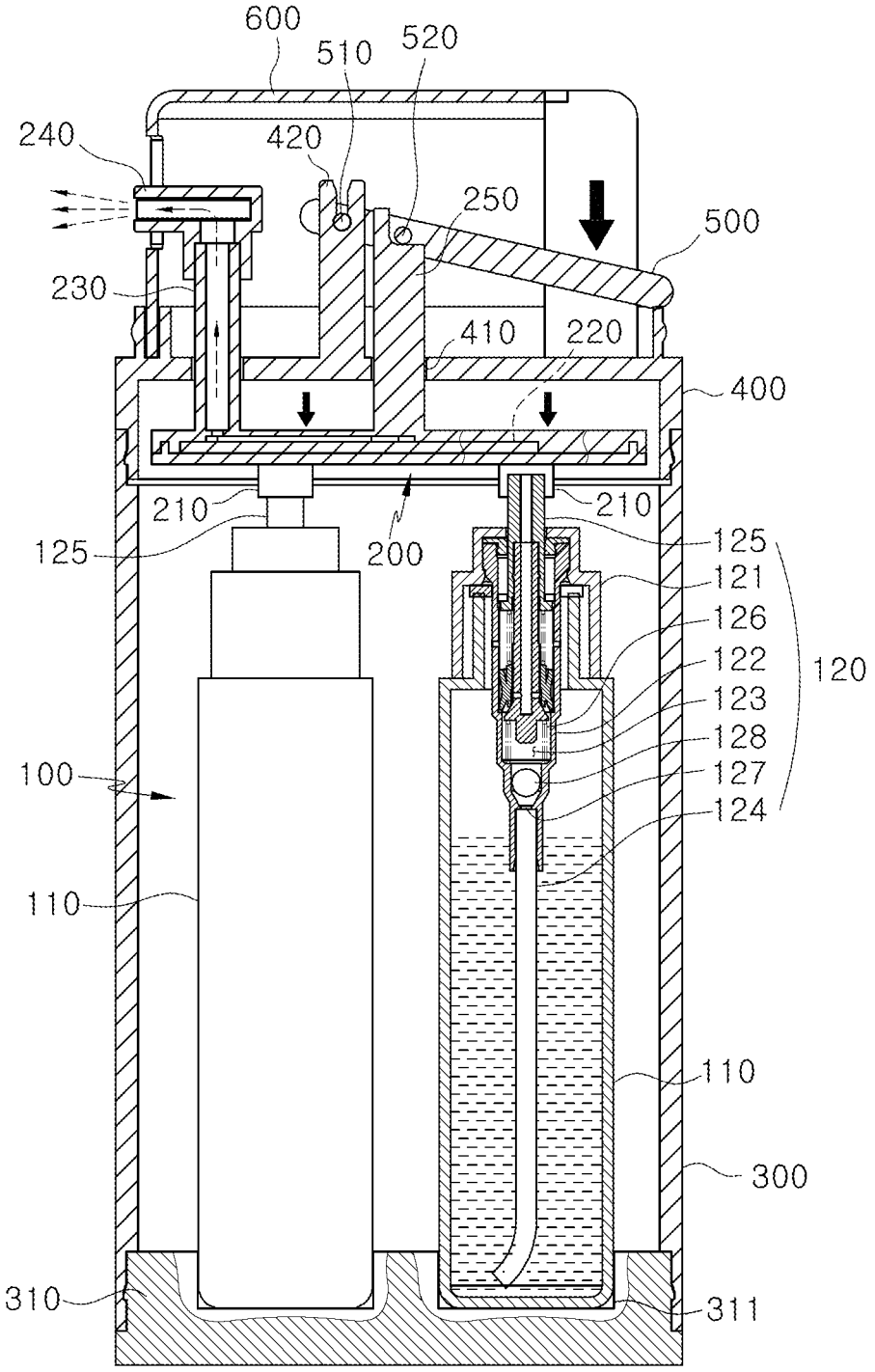
FIG. 7 is a view illustrating the operation of the cosmetic container assembly according to the present invention.

As illustrated in FIG. 7, when the rear end of the lever push button 500 is pressed (see the arrow direction in FIG. 7), the press portion 520 presses the support shaft 250, thus lowering the press plate 200. Accordingly, the piston rods 125 of the pump dispensers 120 of the cosmetic containers 100 coupled to the press plate 200 are simultaneously lowered while overcoming the elastic restoring force of the coil springs 126. When the piston rods 125 are lowered, the pressure in the pressure chambers 123 is increased, and thus the contents contained in the pressure chambers 123 are extruded upwards through the hollow in the piston rods 125. The contents extruded through the pump dispensers 120 of the cosmetic containers 100 are directed toward the outlet port 230 through the discharge channel 320, and are discharged to the outside while being mixed with each other through the discharge port 230 (see the dotted arrow direction in FIG. 7).

When the force applied to the rear end of the lever push button 500 is released, the piston rods 125 of the cosmetic containers 100 are raised by the elastic restoring force of the coil springs 126, and the check valve 128 is opened, whereby the contents contained in the containers 110 are sucked into the suction tubes 124. At this point, because the piston rods 125 are raised, the press plate 200 and the lever push button 500 are maintained in the initial state thereof (see FIG. 2).

By virtue of the repeated pressing action of the rear end of the lever push button 500, the contents contained in the cosmetic containers 100 are transferred to the nozzle tip 240 through the pressure chambers 123 in the cylinders 122, the hollow in the piston rod 125, and the discharge channel 220, and are discharged to the outside while being mixed with each other through the nozzle tip 240.

In other words, the cosmetic container assembly according to the present invention is constructed such that, when the rear end of the lever push button 500 is pressed, the press plate 200 is lowered and thus the pump dispensers 120 of the cosmetic containers 100 are pressed simultaneously, whereby the contents are extruded and discharged simultaneously while being mixed with each other through the outlet port 320. Particularly, it is possible for the pump dispensers 120 of the cosmetic containers 100 to simultaneously pump the contents in response to an action of lightly pressing the rear end of the lever push button 500 by virtue of the principle of a lever. Consequently, the contents in the cosmetic containers 100 are discharged in equal amounts without leaving residue therein through a single pumping action.

Although the cosmetic container assembly of the present invention has been described according to an embodiment to which four cosmetic containers 100 are applied, various numbers of cosmetic containers 100, such as two or three cosmetic containers 100, may be applied to the cosmetic container assembly without being limited thereto.

INDUSTRIAL APPLICABILITY

The present invention may be extensively applied to [cosmetic container assemblies] capable of simultaneously mixing and discharging contents contained in different containers through a single pumping action.

The invention claimed is:

1. A cosmetic container assembly capable of simultaneously discharging multiple kinds of contents through a single pumping action comprising:

a plurality of cosmetic containers (100), each of which includes a container (110), which contains contents therein and is open at an upper end thereof, and a pump dispenser (120), which is mounted in the open end of the container (110) and is capable of pumping the contents in the container (110) to extrude the contents upwards through a hollow piston rod (125) by repeated pressing action of the hollow piston rod (125);

a press plate (200), which is horizontally disposed above the cosmetic containers (100), the press plate (200) including connection ports (210) formed in a lower surface thereof at regular intervals so as to allow upper ends of the piston rods (125) of the pump dispensers (120) to be respectively fitted thereinto, a discharge port (230) formed in a periphery thereof so as to discharge the contents, a discharge channel (220) formed therein so as to connect the connection ports (210) with the discharge port (230), and a support shaft (250) formed in the central region of an upper surface thereof so as to project upwards;

a container housing (300), which is configured to have a cylindrical form so as to surround the cosmetic containers (100) and the press plate (200) and which is open at an upper portion thereof and is provided at a lower portion thereof with a base (310) on which the plurality of cosmetic containers (100) are disposed at regular intervals;

a housing cap (400), which is coupled to the upper portion of the container housing (300), which accommodates therein the cosmetic containers (100) and the press plate (200), so as to cover the upper portion and which is provided in a center thereof with a shaft hole (410), through which the support shaft (250) of the press plate (200) extends upwards, and is provided with a button-supporting shaft (420) in front of the shaft hole (410); and a lever push button (500), which is rotatably coupled at a front end thereof to an upper end of the button-supporting shaft (420) via a shaft (510) and is provided with a press portion (520) configured to press the support shaft (250) of the press plate (200) and which is configured to move the press plate (200) downwards and thus to simultaneously press the pump dispensers (120) of the cosmetic containers (100) to perform a pumping action when a rear end of the lever push button (500) is pressed.

2. The cosmetic container assembly according to claim 1, wherein the discharge port (230) is formed at a peripheral portion of the press plate (200) so as to extend upwards, and is provided at an upper end thereof with a nozzle tip (240) configured to discharge the contents forwards.

* * * * *